United States Patent [19]

McGown

[11] Patent Number: 4,598,505

[45] Date of Patent: Jul. 8, 1986

[54] FLASHING MEMBER

[76] Inventor: Jack A. McGown, 2710 Quincannon, Houston, Tex. 77043

[21] Appl. No.: 699,746

[22] Filed: Feb. 8, 1985

[51] Int. Cl.[4] ..... E04D 1/36; E04D 13/14

[52] U.S. Cl. ..... 52/58; 52/199; 98/42.21

[58] Field of Search ..... 52/199, 58; 98/42.21

[56] References Cited

U.S. PATENT DOCUMENTS

| | | | |
|---|---|---|---|
| D. 121,410 | 7/1940 | Gunter | D23/153 |
| D. 189,801 | 2/1961 | Breidert | D23/153 |
| D. 203,484 | 1/1966 | Rousey et al. | D23/153 |
| D. 256,725 | 9/1980 | Stahl | D23/153 |
| 1,381,630 | 6/1921 | Goodrich | 98/42.22 X |
| 1,611,005 | 12/1926 | Dexter . | |
| 2,127,099 | 8/1938 | Whitaker | D23/153 X |
| 2,232,027 | 2/1941 | Gunter . | |
| 2,404,961 | 7/1946 | Hoch . | |
| 2,410,950 | 11/1946 | Knutson . | |
| 2,625,094 | 1/1953 | Bonforte | 98/42.21 |
| 2,664,177 | 12/1953 | Hammitt et al. | 52/58 X |
| 3,213,776 | 10/1965 | Adams . | |

FOREIGN PATENT DOCUMENTS

| | | | |
|---|---|---|---|
| 668047 | 3/1952 | United Kingdom | 98/42.1 |

*Primary Examiner*—Alfred C. Perham
*Attorney, Agent, or Firm*—Guy E. Matthews

[57] ABSTRACT

A flashing member having a two leg construction, such member being adapted for use between the ends of corrugated roof panels adjacent to the open space below ridge type ventilators and the base of the ventilator in its resting position at the ridge of a building roof. The flashing member has a generally V-shape transverse profile, and includes one leg having corrugations formed thereupon to correspond with the surface of the corrugations of the roof panel, and a second leg interval with the corrugated leg, such leg being angularly disposed with respect to the corrugated leg and formed with a substantially smooth, flat and uncorrugated surface adapted to provide bearing support for the ventilator in its resting position. A watertight seal is then disposed between the ventilator and the roof panels.

13 Claims, 4 Drawing Figures fig. 2
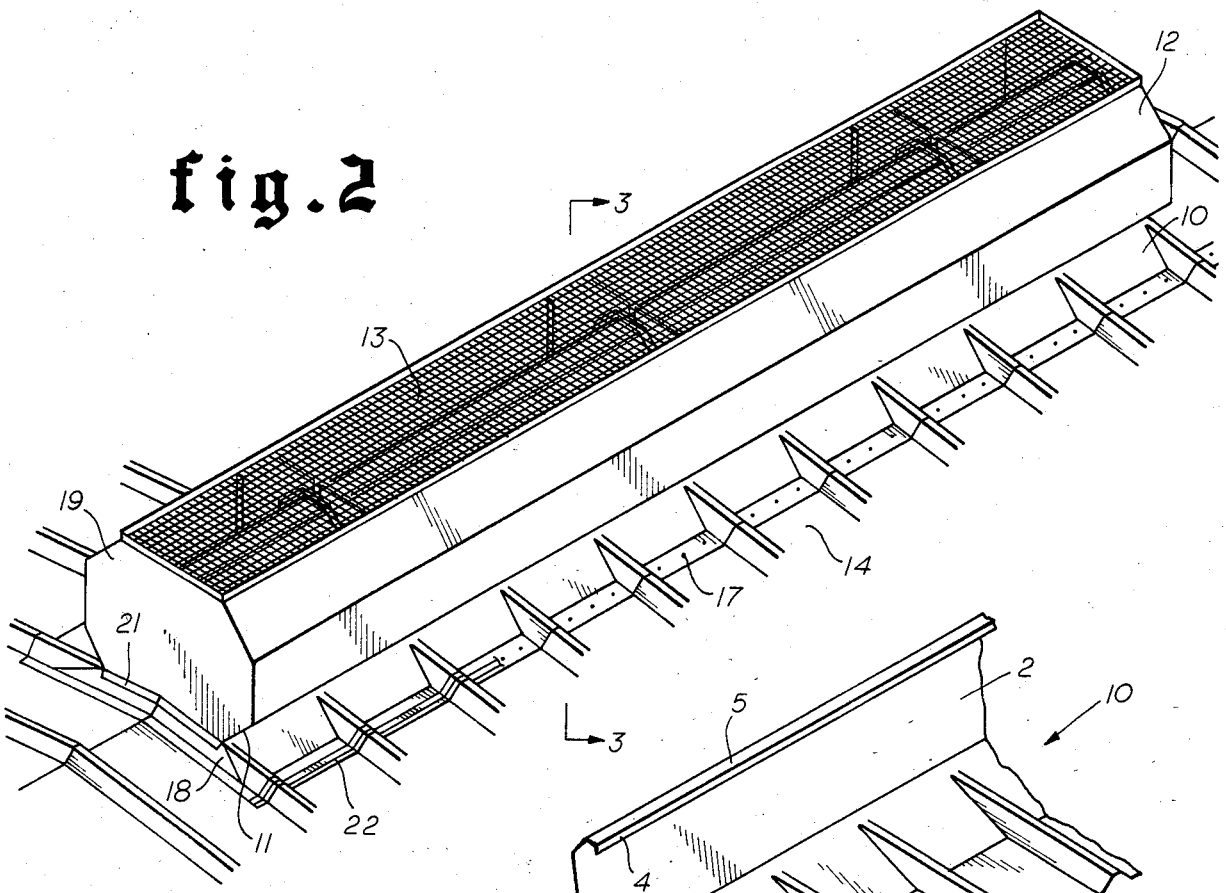
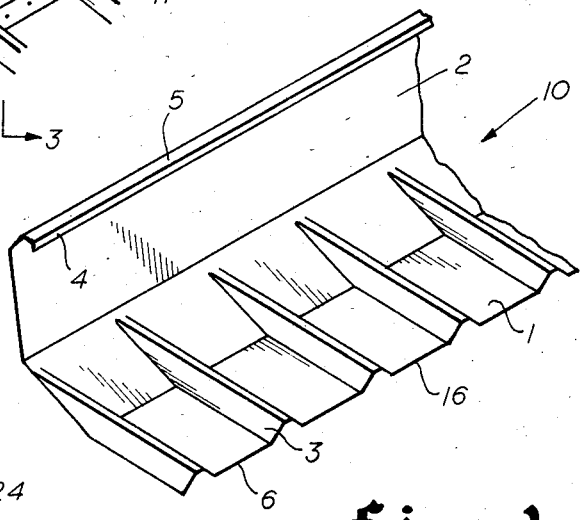
fig. 1
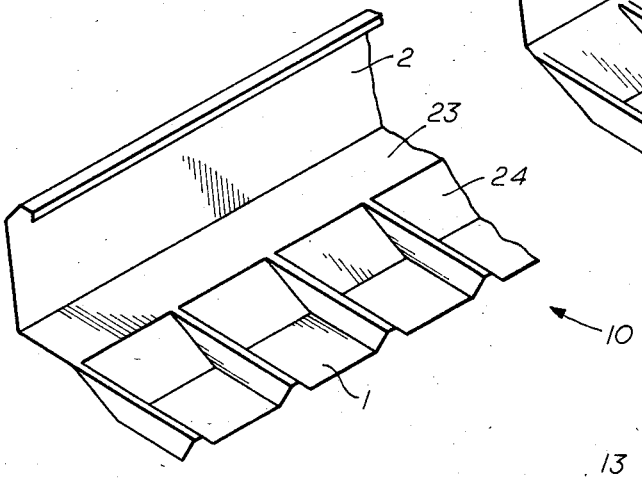
fig. 4
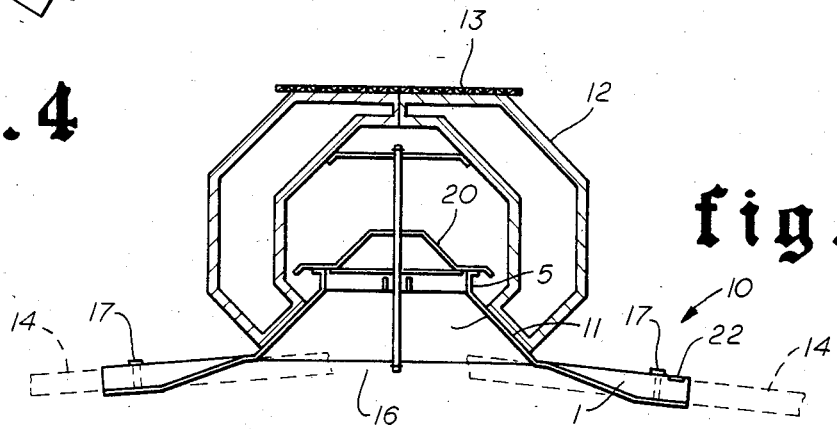
fig. 3

FLASHING MEMBER

BACKGROUND OF THE INVENTION

This invention generally relates to a flashing member used in the building construction industry to seal against or prevent the leakage of rain into the interior of a building. In particular, this invention relates to a flashing member for use between the ends of corrugated roof panels adjacent to the open space between ridge type ventilators and the base of the ventilator in its resting position at the ridge of the building roof.

The flashing members described in the prior art generally detail two-piece constructions which are adapted to engage or cooperate with other building fixtures or roof structures to provide a waterproofing seal. The prior art also discloses flashing members which are engageable with the structural framework of floors, doors, windows or the like. Still further, and of particular relevance to the invention of the present disclosure, are prior art references which reveal means for rainproofing around an opening disposed through a roof, such opening being utilized for the placement of a ventilator or like structure therein. The flashing members shown in the prior art, however, provide sealing means for structures which have a flat or planar flange extending from the supporting edge of the structure. These flashing members are not suitable for ventilators or like structures which are constructed without an extending flange. In addition, the flashing members of the prior art provide no supplemental structural support for the ventilators or roof structures to which they are adapted.

SUMMARY OF THE INVENTION

In view of the foregoing, it is an object of the present invention to provide a flashing member which will serve in the elimination of fluid leaks around ventilators where they join the corrugated roof panels.

Another object of this invention is to provide a flashing member which is adapted for assembly with ventilators which are constructed without flat or planar flanges extending from the supporting edges thereof.

A further object of this invention is to provide a flashing member which will provide supplemental support for the ventilator structure.

These and other objects of the present invention are achieved through the provision of a flashing member which is preferably formed from sheet material, such flashing member having a generally V-shaped transverse profile. This flashing member details a two leg configuration, one such leg being disposed with corrugations formed thereupon, such corrugations having a surface profile designed to conform with the surface of the corrugations of the roof panel, and a second leg being integrally formed with the corrugated leg, such leg being angularly disposed with respect to such corrugated leg, and formed with a substantially smooth, flat, uncorrugated surface which is adapted to provide bearing support for the ventilator. The flashing member of the present disclosure also provides for a waterproofing seal being disposed between the ventilator and the roof panels. This seal is provided by abutting the uncorrugated leg of the flashing member with the ventilator housing so as to conform with the supporting edge of that housing.

Additional and further features of the present invention will become more apparent from the following description, which in conjunction with the accompanying drawing figures, are illustrative of the invention.

BRIEF DESCRIPTION OF THE DRAWINGS

FIG. 1 is an isometric view of the flashing member of the present disclosure.

FIG. 2 is a perspective view of the present invention in conjunction with a ridge type ventilator.

FIG. 3 is a cross-sectional view taken along the line 3—3 of FIG. 2.

FIG. 4 is a partial perspective view of a further embodiment of the flashing member of the present disclosure.

DESCRIPTION OF THE PREFERRED EMBODIMENTS

Referring now to FIG. 1, the preferred embodiment of the present invention details a flashing member 10 which comprises a corrugated leg or skirt 1 integrally designed to cooperate with an inclined uncorrugated leg 2. Flashing member 10 is preferably formed from a unitary sheet of suitable material such as galvanized sheet iron. It may, however, be made of other deformable materials such as plastic, lead, soft copper, or the like, if desired. The corrugated leg 1 is disposed with corrugations 3 formed thereupon, such corrugations being of a suitable or standard size, and having a surface profile configured to conform with the surface of the corrugations of the roof panels. The uncorrugated leg 2, is integrally extended in transition into the corrugated leg 1, and may be adapted to be disposed at various selected angles with respect to the corrugated leg 1.

Uncorrugated leg 2 further details a substantially smooth, flat, planar surface having a remote edge 4 which is bent back against itself so as to form a bearing surface 5, such bearing surface 5 being useful in providing support for a closure cap member 20 which is normally utilized with ventilators designed for controlling air exchange within a building. As seen in FIGS. 2 and 3, uncorrugated carrier leg 2 also serves to form a waterproofing seal around the supporting surface edge 11 of a ventilator housing 12, when the ventilator 13 is installed and situated adjacent to the top surface of the uncorrugated leg 2. As can be seen, this ridge type ventilator 13 is constructed without flat or planar flanges extending from its supporting surface edge 11. The flashing member 10, however, may be formed to be adaptable with ventilators which are constructed with flanges which extend from their supporting edges as hereinafter described.

FIGS. 2 and 3 further illustrate the utilization of the flashing member 10 of FIG. 1 in conjunction with a ridge type ventilator 13. Therein corrugated roof panels 14 are secured in place on the purlin of a roof (not shown) with groove fasteners such as metal screws or the like (not shown). In this arrangement, flashing member 10 overlaps the corrugated roof panel 14 with the corrugations 3 of the flashing member 10 conforming with the corrugations of the roof panel 14. Illustratively, flashing member 10 is held secure upon the roof panel 14 by a plurality of flashing fasteners 17 which are attached near the remote edge of the corrugated leg 1. Further, flashing member 10 is situated a suitable distance from the roof opening 16 so as to allow the uncorrugated leg 2 thereof to extend beneath the ventilator housing 12 into the interior of the ventilator 13 so that the bearing surface 5, formed at the remote edge 4 of the uncorrugated leg 2, may be disposed to provide support to and facilitate alignment of the ventilator cap member 20.

Advantageously, ventilator housing 12 rests upon the uncorrugated leg 2 of the flashing member 10. The ventilator 13 is then secured in place by end skirts 18 which are designed to fit beneath flashing member 10 to ride along the ridges of the corrugations 3 of roof panel 14. These end skirts 18 are secured to the end wall 19 of the ventilator housing 12 by end skirt fasteners 21. A permanent rope seal 22 may then be disposed between roof panels 14 and flashing member 10 along the remote edge 6 of the corrugated leg 1 of flashing member 10 to provide a watertight seal around the ventilator 13.

While the preferred embodiment of the present invention is shown in conjunction with a ridge-type ventilator constructed without flat or planar flanges extending from the supporting edges thereof, the flashing member 10 may also be formed for utilization in conjunction with ventilators constructed with flanges. As illustrated in FIG. 4, the flashing member 10 details a flat horizontal surface 23 designed to extend along an adjoining edge 24 of the corrugated leg 1. Surface 23 also extends along uncorrugated leg 2 as shown. This flat horizontal surface 23 is angularly disposed with respect to the corrugated leg 1 so as to conform with the angle of the extending ventilator flanges. The ventilator flanges may then be fastened to the horizontal surface 23 by any suitable means, and a rope seal, or other sealing substance may be disposed or applied between the ventilator flanges and the horizontal surface 23 to provide for further waterproofing.

While alternative forms and uses of the flashing members of the present invention have been shown and described herein, it is contemplated that the present invention is capable of other applications, and that the disclosed flashing members may be produced in other alternative shapes. In view thereof, it should be understood that various changes may be made in and to the present invention without departing from the spirit thereof, such changes, modifications and adaptations being included in the scope of this invention.

What is claimed is:

1. The combination of an elongated roof ventilator including, (a) an internal elongated air closure cap member, (b) a lower supporting surface edge disposed along each long side of said ventilator, and (c) a pair of supporting flashing members connected to mount said ventilator on a roof and to operatively support said air closure cap member within said ventilator, each said flashing members comprising:

(1) an elongated skirt member corrugated as appropriate to conform to the corrugations of a selected roof;

(2) an elongated uncorrugated carrier member extending in transition from said skirt and upwardly inclined over an opening in said roof, said carrier member supporting said surface edge of said ventilator;

(3) an elongated remote edge member extending from said carrier member and including an elongated bearing face for supporting said cap member; and (4) said flashing member being a unitary member.

2. The combination of claim 1 further including an elongated horizontal mounting surface extending from said carrier member to said skirt and separately supporting said surface edge of said ventilator.

3. The combination of claim 2 wherein said carrier member extends at a selected angle from said skirt member.

4. The combination of claim 2 wherein said elongated ventilator further includes a pair of end skirts closing the ends of said ventilator and the end of said opening in said roof, each of said skirt ends extending underneath each end of each said skirt.

5. The combination of claim 2 wherein sealing means is disposed between said skirt and said roof.

6. The combination of claim 1 wherein said carrier member extends at a selected angle from said skirt member.

7. The combination of claim 1 wherein said elongated ventilator further includes a pair of end skirts closing the ends of said ventilator and the ends of said opening in said roof, each of said end skirts extending underneath each end of each said skirt.

8. The combination of claim 1 wherein sealing means is disposed between said skirt and said roof.

9. The combination of claim 1 wherein said flashing member is comprised of a formable sheet material.

10. Improved elongated roof flashing members combined in pairs as elements of an elongated ventilator having an elongated closure cap member and two supporting surface edges with each said member to form a combination of said flashing members comprising:

(a) an elongated skirt member corrugated as appropriate to conform to the corrugations of a selected roof;

(b) an elongated uncorrugated carrier member extending in transition from said skirt upwardly over an opening in said roof and supporting one of said surface edges of said ventilator; and (c) an elongated remote edge member extending from said carrier member and including an elongated bearing face for supporting said cap member.

11. The combination of claim 10 further including an elongated horizontal mounting surface extending from said carrier member to said skirt and separately supporting said one of said surface edges of said ventilator.

12. The combination of claim 10 wherein said elongated ventilator further includes a pair of end skirts closing the ends of said ventilator and the ends of said opening in said roof, each of said endskirts extending underneath each end of each said skirt.

13. The combination of claim 10 wherein said flashing member is comprised of a formable sheet material.

* * * * *